US010934747B2

(12) United States Patent
Inan

(10) Patent No.: US 10,934,747 B2
(45) Date of Patent: Mar. 2, 2021

(54) MOTOR VEHICLE LOCK

(71) Applicant: Kiekert AG, Heiligenhaus (DE)

(72) Inventor: Ömer Inan, Dorsten (DE)

(73) Assignee: Kiekert AG, Heiligenhaus (DE)

( * ) Notice: Subject to any disclaimer, the term of this patent is extended or adjusted under 35 U.S.C. 154(b) by 656 days.

(21) Appl. No.: 15/553,600

(22) PCT Filed: Feb. 12, 2016

(86) PCT No.: PCT/DE2016/100066
§ 371 (c)(1),
(2) Date: Sep. 18, 2017

(87) PCT Pub. No.: WO2016/134698
PCT Pub. Date: Sep. 1, 2016

(65) Prior Publication Data

US 2018/0038138 A1 Feb. 8, 2018

(30) Foreign Application Priority Data

Feb. 25, 2015 (DE) ..... 10 2015 002 452.3

(51) Int. Cl.
*E05B 79/08* (2014.01)
*E05B 79/20* (2014.01)
(Continued)

(52) U.S. Cl.
CPC ..... *E05B 79/08* (2013.01); *E05B 63/143* (2013.01); *E05B 79/20* (2013.01); *E05B 81/06* (2013.01); *E05B 81/16* (2013.01); *E05B 83/40* (2013.01)

(58) Field of Classification Search
CPC ..... E05B 77/46; E05B 77/465; E05B 81/06; E05B 81/16; E05B 77/48; E05B 77/50;
(Continued)

(56) References Cited

U.S. PATENT DOCUMENTS 4,505,500 A * 3/1985 Utsumi ..... E05B 83/38 292/48
6,722,714 B2 * 4/2004 Ooe ..... E05B 81/06 292/216
(Continued)

FOREIGN PATENT DOCUMENTS

CN 101086192 A 12/2007
DE 10210797 A1 12/2003
(Continued)

OTHER PUBLICATIONS

International Search Report and Written Opinion for corresponding Patent Application No. PCT/DE2016/100066 dated Jun. 6, 2016.
(Continued)

*Primary Examiner* — Christine M Mills
(74) *Attorney, Agent, or Firm* — Renner, Otto, Boisselle & Sklar, LLP

(57) ABSTRACT

The object of the invention is a motor vehicle door lock (1) comprising a locking mechanism with a rotary latch and at least a lock pawl, a release lever (12), a first actuating lever (8), wherein the locking mechanism can be unlocked by means of the release lever (12) and wherein the release lever (12) can be actuated by means of the actuating lever (8). The invention is characterized in that a further motor vehicle door lock (2) is provided, wherein said further motor vehicle door lock (2) can be actuated by means of the first actuating lever (8).

12 Claims, 8 Drawing Sheets

Figure 1:
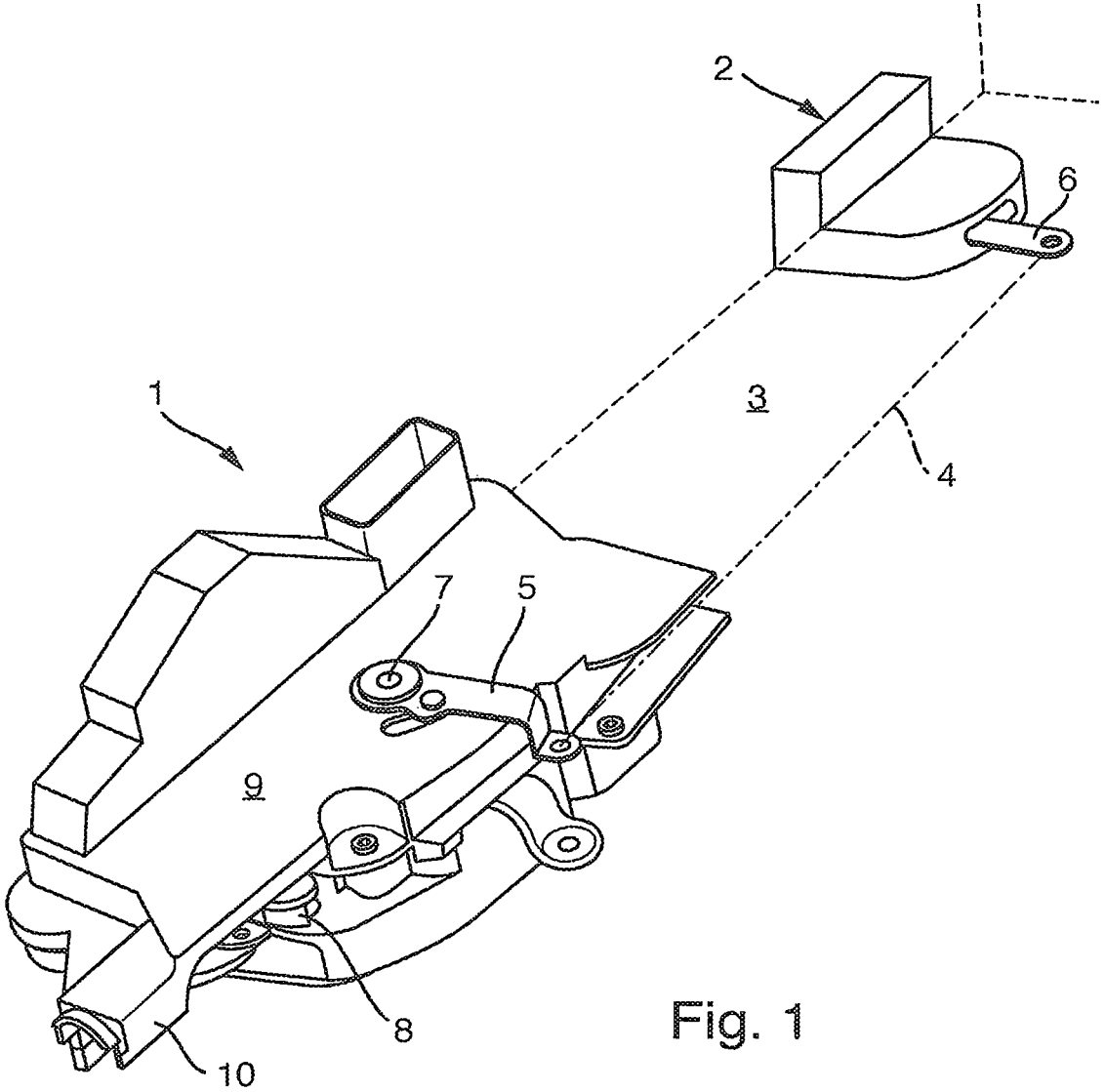

(51) Int. Cl.

| | |
|---|---|
| ***E05B 83/40*** | (2014.01) |
| ***E05B 81/06*** | (2014.01) |
| ***E05B 81/16*** | (2014.01) |
| ***E05B 63/14*** | (2006.01) |

(58) Field of Classification Search

CPC ..... E05B 77/54; E05B 79/08; E05B 79/10; E05B 79/20; E05B 83/40; E05B 79/12; E05B 79/14; E05B 79/16; E05B 63/143; E05B 83/38; Y10S 292/23; Y10S 292/03; Y10T 292/1082; Y10T 292/1047; Y10T 292/0848; Y10T 292/0849; Y10T 292/0853; Y10T 292/0857; Y10T 292/1045; Y10T 292/1048

USPC ..... 292/201, 216, 44, 45, 48, 52, 214, 217, 292/DIG. 23, DIG. 3

See application file for complete search history.

(56) References Cited

U.S. PATENT DOCUMENTS

| | | | | |
|---|---|---|---|---|
| 7,434,854 | B2 * | 10/2008 | Fujimatsu | E05B 81/25 292/336.3 |
| 2006/0125245 | A1 * | 6/2006 | Graute | E05B 81/14 292/216 |
| 2007/0284892 | A1 | 12/2007 | Nozawa | |
| 2013/0241213 | A1 * | 9/2013 | Cox | E05C 3/12 292/4 |
| 2014/0001771 | A1 | 1/2014 | Shibayama et al. | |
| 2018/0044952 | A1 * | 2/2018 | Inan | E05B 63/143 |
| 2018/0044953 | A1 * | 2/2018 | Inan | E05B 79/20 |

FOREIGN PATENT DOCUMENTS

| | | | | |
|---|---|---|---|---|
| DE | 102004043220 | A1 * | 3/2006 | E05B 83/04 |
| DE | 102004061481 | A * | 6/2006 | E05B 77/48 |
| DE | 10 2006 020 344 | A1 | 10/2007 | |
| DE | 102006019336 | A1 | 10/2007 | |
| DE | 102007045227 | A1 | 2/2008 | |
| DE | 10 2009 051 432 | A1 | 5/2011 | |
| GB | 2 105 777 | A | 3/1983 | |

OTHER PUBLICATIONS

Translation of First Office Action dated Nov. 28, 2018 for Chinese Application No. 201680011865.5.

Translation of Second Office Action for Chinese Application No. 201680011865.5.

* cited by examiner

MOTOR VEHICLE LOCK

The invention relates to a motor vehicle latch having a locking mechanism, with a catch and at least a pawl, a triggering lever and a first activation lever, whereby the locking mechanism can be unlocked by means of the triggering lever and whereby the triggering lever can be activated by means of the activation lever.

Motor vehicle door latches are used to latch doors, flaps or hoods in a motor vehicle. If it is customary, for example, for a door latch to be used on passenger vehicles, this changes when the size of the door exceeds a certain size, for example. In order to guarantee that large doors are also latched properly in every area of the door opening, it can be necessary to use two or more door latches for the proper latching of the door. For example, this could be the case if vehicles are equipped without a B-pillar and the doors are assigned a stabilizing function for the frame. Furthermore, for example, sliding doors can require a second motor vehicle door latch. Several door latches are preferably used if the door is very high. When using two or more door latches, it is customary to use a required number of secondary latches in addition to a primary latch Primary and secondary latches are arranged in such a way that sufficient closing force is available at every location on the door opening in order to maintain the door in its closed position, to stabilize the motor vehicle and to provide sufficient closing force in order to keep the door sealed against the door seal. If, for example, the door is moved in the area of the hinges in a situation-related manner when closing against the door seal profile and positioned in the area of the hinges so that sufficient sealing pressure is generated in order to seal the door, this force needs to be applied by the motor vehicle door latch or set against the door seal in order to also position the door in a sealing manner in this area. If the door is very high, for example, it may be necessary to use one, two or more secondary latches in addition to the primary latch in order to generate relevant positioning forces which seal the door circumferentially.

An example of a sliding door with a primary latch and a number of secondary latches is known from DE 10 2006 020 344 A1. The sliding door is revealed there in an exemplary manner with a primary latch and a multitude of secondary latches. By means of a common control unit and separate transmitters, all latching systems, such as the primary latch and secondary latches can be acted on in order to activate and/or deactivate these. An activation of the latching systems occurs as usual, for example, by means of an external door handle or an internal door handle, but it can also occur in a contactless manner by means of a sensor. Starting from the activation devices, the latches can then be activated or deactivated and/or an impact can be had on the locking or latching functions.

A class-specific motor vehicle door latch is known from DE 10 2009 051 432 A1. The motor vehicle door latch has a locking mechanism consisting of a catch and at least a pawl, whereby the catch can be engaged with a latch holder and the pawl ratchets the locking mechanism in the closed state. In order to open the ratcheted locking mechanism, a coupling lever is connected to the pawl by means of a pin so that with a suitable alignment of the coupling lever and an activation of the coupling lever can be activated in this example by means of an activation lever so that the locking mechanism can be unlocked. The coupling lever serves as a coupling between the pawl and the activation lever.

In addition to the triggering, i.e. the unlocking of the locking mechanism, the coupling lever is assigned a further function. According to the position of the coupling lever, an activation of the triggering or activation lever can be made ineffective, i.e. the motor vehicle door latch is bolted. In order to bolt the motor vehicle door latch, an external ratcheting lever, an internal ratcheting lever or an electrical drive can be used. All three locking mechanisms act on a locking lever which in turn engages with the coupling lever and can engage or disengage the coupling lever with the triggering or activation lever.

If sliding doors or lateral doors, of transporters, for example, are equipped with above-average height with a primary latch and a secondary latch, the primary and secondary latch are thus present in the door at a distance from one another. A problem which arises from such latch combinations of primary and secondary latch is that in order to open both latches only an activation lever is available, such as an internal door handle or an external door handle. The opening stroke of the external and internal door handle must then be used to unlock both latches. It must hereby be heeded that the available activation path of the internal or external handle involves the present tolerances and the tolerances to be expected, the distances to be bridged between the latches and the triggering forces occurring or required in the motor vehicle door latches. The triggering forces of the secondary latch are thus added to the triggering forces of the primary latch so that a multitude of requirements are placed on a mechanical connection of a secondary latch on a primary latch.

The task of the invention is to provide an improved motor vehicle door latch which enables a connection between the primary latch and the secondary latch. Furthermore, it is a task of the invention to provide a motor vehicle door latching system which activates a secondary latch starting from a present lateral door latch and without a change to the latch ratios in the present lateral door latch. The task of the invention is also to provide a cost-effective solution of a simple construction of a connection between a primary and secondary latch.

The task is solved according to the invention by the characteristics of the independent claim 1. Advantageous designs of the invention are stated in the sub-claims. It is pointed out that the embodiment examples described hereafter are not restrictive; instead, any possible variations are possible of the characteristics described in the description and the sub-claims.

According to patent claim 1, the task of the invention is solved by a motor vehicle door latch being provided, having a locking mechanism with a catch and at least a pawl, a triggering lever and a first activation lever, whereby by means of the triggering lever the locking mechanism can be unlocked and whereby, by means of the activation lever, the triggering lever can be activated, whereby a further motor vehicle door latch is provided for and that by means of the first activation lever the further motor vehicle door latch, preferably a secondary latch, can be activated. By means of the formation of a motor vehicle door latch according to the invention, the possibility is now given of providing an improved connection between a primary latch and a secondary latch, whereby no changes need to be taken into account in relation to the lever ratios existing in the motor vehicle door latch. If, within the scope of the description of a motor vehicle door latch, a latch, a primary latch, a secondary latch or a lateral door latch is spoken of, these descriptions are therefore synonymous for a motor vehicle door latch. Due to a direct connection of the activation lever to an activation lever of the further motor vehicle door latch, in particular of a secondary latch, the identical activation paths are available to the secondary latch for activation of the secondary latch. Between the first activation lever of the motor vehicle door latch and the further motor vehicle door latch a connection can be provided for, for example, by means of a Bowden cable.

The main latch and secondary latch can concur, i.e. identical latches can be used, however, the secondary latch will preferably be of a simpler design as the latching and generation of a closure force is in the foreground in the area of the secondary latch. Both latches, primary latch and secondary latch preferably have a locking mechanism with a catch and at least a pawl. A triggering lever acts directly on the locking mechanism and is able to unlock the locking mechanism. According to the class-specific state of the art, the triggering lever is described as a coupling lever in an exemplary manner which can be activated by an activation lever. The activation lever can be an internal activation lever or an external activation lever. The internal and external activation levers can then be connected to the external door handle and the internal door handle respectively, for example.

The motor vehicle door latch as a primary latch is at a distance from the further motor vehicle door latch, the secondary latch arranged in a sliding door, for example. Both door latches work, for example, with a latch holder attached to the chassis of the motor vehicle. Naturally, the motor vehicle door latches can also be mounted on the motor vehicle and the latch holder can be mounted on the sliding door, for example. As an example, the door latches can be arranged above one another on a very high door, for example, and thus latch the door or sliding door unilaterally. If the sliding door is constructed in such a way that a motor vehicle latch needs to be arranged at opposite ends of the door, the door latches can therefore also be arranged at a distance from one another on the respectively opposite sides of the door. It is self-evident that the arrangement of the primary latch and one, two or several secondary latches are dependent on the dimensions and requirements of the respective door as according to the dimension and construction of the motor vehicle at different sites different forces need to be provided for the proper latching and sealing of the motor vehicle door.

In one embodiment form of the invention, a second activation lever is provided for on the motor vehicle door latch, the primary latch, and the second activation lever can be activated by means of the first activation lever, whereby the further motor vehicle door latch can be activated by means of the second activation lever. Use of a second activation lever on the primary latch offers the advantage of impacting the lever force ratios to be transmitted. A connection between the first activation lever and the second activation lever in the primary latch can be thus be formed in such a way that a force to be transmitted can be defined on the secondary latch. In particular in the case in which a different construction is present between the primary latch and the secondary latch, it is then possible to proceed with a force distribution. If, for example, by means of the external door handle forces of approximately 20 Newtons can be applied to the activation lever in the primary latch, this force must therefore be distributed to unlock the locking mechanism in the primary latch and the secondary latch in order to provide sufficient operating convenience for the user of the motor vehicle latch. In particular by means of the use of a second activation lever, the possibility therefore exists of proceeding with a force distribution by means of a connection between the first and second activation lever. In addition to the distribution of forces, the activation paths of the latches can also be impacted. If, for example, lesser activation paths are required on the secondary latch to trigger the locking mechanism, the angular movements of the activation lever in the primary and secondary latch can therefore be impacted by a selection of the lever ratios between the first and second activation levers.

If the second activation lever is connected to the first activation lever by means of a coupling lever, a further advantageous embodiment example of the invention therefore results. A coupling lever hereby enables a firm connection to be produced between the first and second activation lever. Use of a coupling lever hereby enables the movements, in particular the angular movements of the lever, to be transmitted in a play-free manner. If the coupling lever is preferably made of plastic, a connection can therefore be produced which is cost-effective to produce and also only involves a light additional weight into the triggering mechanism for the secondary latch.

A further embodiment example of the invention results when the coupling lever is connected to the second activation lever in a form-fitting manner and/or detachably. For example, if the coupling lever is firmly connected to the first activation lever, the coupling lever can be disengaged with the second activation lever by means of a form-fitting and/or detachable connection between the coupling lever and the second activation lever. This can be advantageous in particular if, for example, a locking function is striven towards or is to be executed for the secondary latch. If the first activation lever is disengaged from the locking mechanism by means of a locking device present in the primary latch, according to the invention the possibility therefore now exists of also disengaging the coupling lever with the second activation lever for the secondary latch. A locking function can hereby be executed for the secondary latch. This is advantageous in particular if the secondary latch possesses a simpler construction and, for example, only consists of a locking mechanism with an unlocking mechanism.

According to a further embodiment of the invention, the coupling lever can be connected to the second activation lever by means of a graded mandrel arranged on the second activation lever. A solution of a simple construction but at the same time favorable construction in relation to the engagement ratios can be achieved by the use of a graded mandrel in the second activation lever. A preferably cylindrical graded mandrel offers the possibility of providing favorable engagement ratios between the coupling lever and the graded mandrel with relevant adjustment of the coupling lever and at the same time the possibility of providing safe functionality for engagement and disengagement. Furthermore, a graded mandrel can be manufactured cost-effectively and can be easily connected to the activation lever. A further embodiment form of the invention results if the coupling lever is pivotably accommodated in the motor vehicle door latch in such a way that the coupling lever directly follows a movement of the first activation lever.

It is hereby conceivable that an accommodation of the coupling lever is provided for on the activation lever. Accommodation can be provided for, for example, in the form of a cylindrical extension on which the coupling lever is pivotably accommodated and incorporated. Direct accommodation on the first activation lever hereby enables the angular movements of the first activation lever which is also pivotably accommodated in the primary latch to be transferred to the second activation lever in a play-free manner and thus to transfer the secondary latch without loss of play to the secondary latch. Accommodation on the first activation lever also gives the advantage that work can take place with a small number of components so that cost-effective production is achieved in turn.

A further embodiment form according to the invention results when the second activation lever is accommodated on an axis of a locking element, in particular a locking lever. The connection of the second activation lever in the primary latch simultaneously gives several advantages. On the one hand, a locking lever can be used to unbolt or bolt the coupling lever due to the direct proximity of the locking element to the second activation lever and furthermore construction space and components can be saved by the use of an available axis. If the axis is used for incorporation of the locking element in order to accommodate the second activation lever for the secondary latch, only the present axis needs to be extended in order to provide a bearing point for the activation lever of the secondary latch. Furthermore, recourse can be had to the present construction space which, in turn, benefits the required space for the activation elements of the secondary latch.

If the axis simultaneously serves to mount a locking mechanism component, a further embodiment form of the invention therefore results. If the axis for mounting the second activation lever not only serves to accommodate a locking element, but also to mount a locking mechanism component, the number of constructional elements required can therefore be further reduced. Furthermore, this is advantageous as the locking mechanism axis is preferably made of a metallic material, whereby stable accommodation can be guaranteed for the locking element on the one hand, but also for the second activation lever. In particular in the transmission of activation forces, in extreme situations a jamming of the closure components can occur, such as the locking mechanism or lever mechanisms so that large forces sometimes need to be conducted over the activation mechanism. In this case and taking into account permanent stability, it is advantageous to provide a metal axis for accommodation of the activation lever.

A further embodiment form of the invention results when the coupling lever can be disengaged with the second activation lever by means of the locking element. If the second activation lever for the secondary latch is accommodated on the axis of the locking element and if the coupling lever engages in a form-fitting and/or detachable manner into the second activation lever, according to the invention the possibility exists of disengaging the coupling lever with the second activation lever by means of a pivoting movement of the locking element. For example, this can occur by the coupling lever being completely disengaged from the activation lever. However, it can also occur that the coupling lever is moved into a position in which activation of the coupling lever does not act on the second activation lever. For example, this can be attained by a relevant design so that in one position of the coupling lever a force can be initiated onto the second activation lever and in another position of the coupling lever the form fit is disengaged. Advantageously the locking element and in particular the locking lever therefore serves to execute a locking function for the secondary latch.

If the bearing point of the coupling lever and the engagement point of the coupling lever is selected on the second activation lever in such a way that the angular movements of the activation lever concur, a further embodiment form of the invention therefore results. Advantageously the engagement points of the coupling lever can be selected on the first and second activation lever in such a way that the angular movements of the activation lever concur. For example, this can be advantageous if the angular movements of the activation lever concur to trigger the locking mechanism in the primary and secondary latch. Naturally, it is also possible to select different angular movements by a relevant selection of the bearing points of the coupling lever on the first and second activation lever in such a way that different angular movements are executed in the triggering mechanisms of the primary and secondary latch.

The invention is described in further detail below with reference to the attached drawings on the basis of the preferred embodiments. However, the principle applies that the embodiment example does not restrict the invention but only constitutes an advantageous embodiment. The characteristics depicted can be executed individually or in combination, individually or in combination with other characteristics of the description, as the patent claims are also executed individually or in combination.

Figure 2:
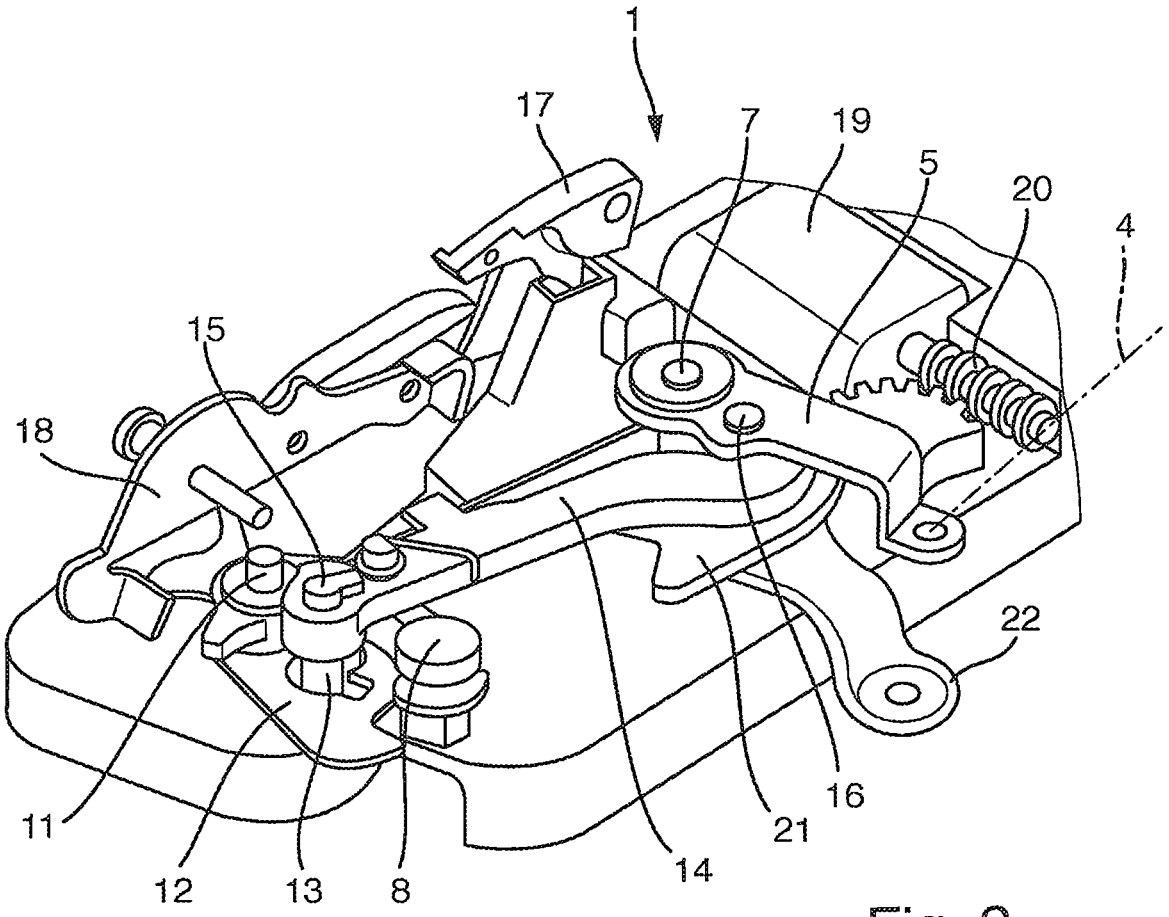
Figure 3:
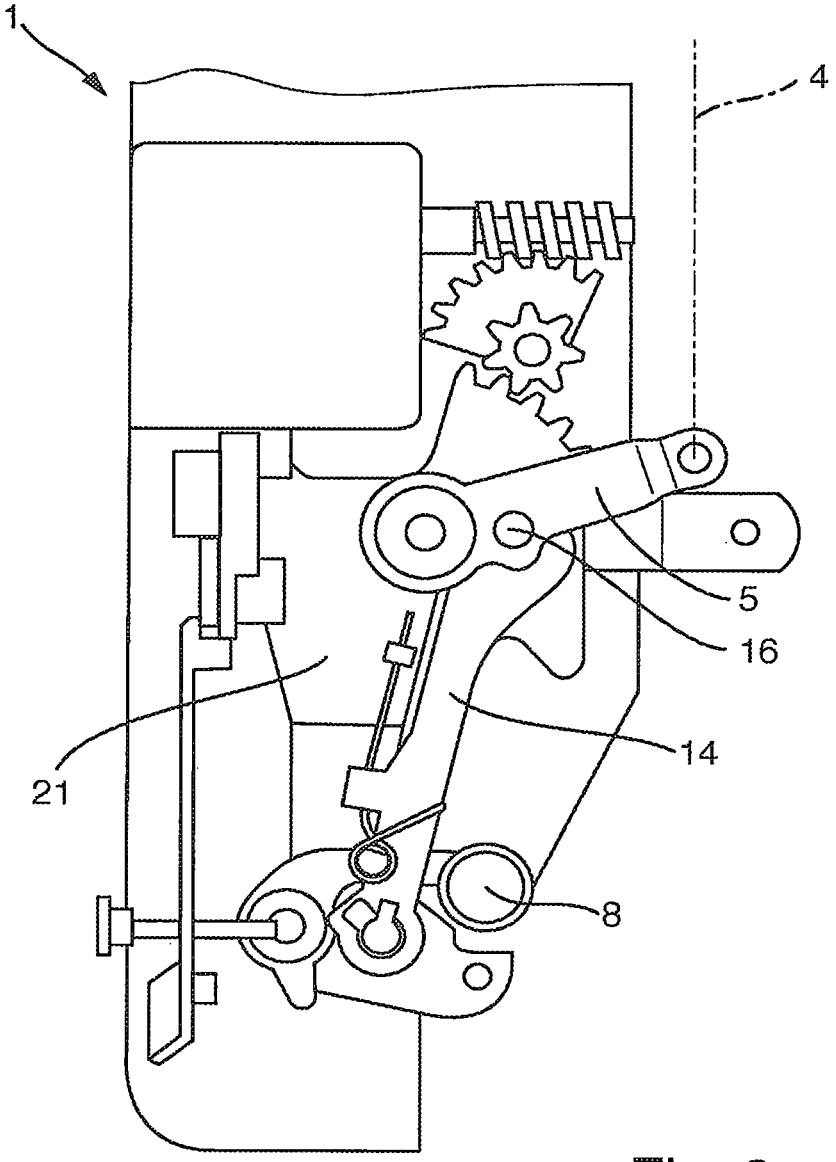
Figure 4:
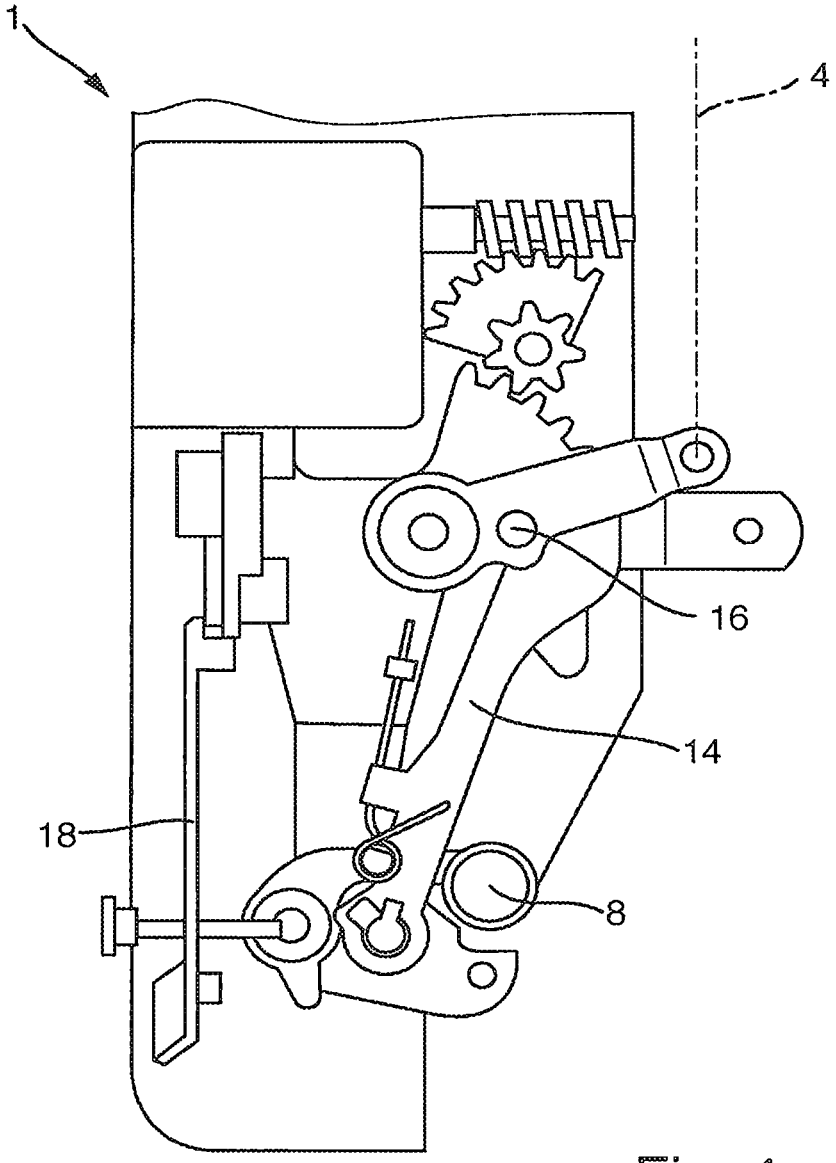
Figure 5:
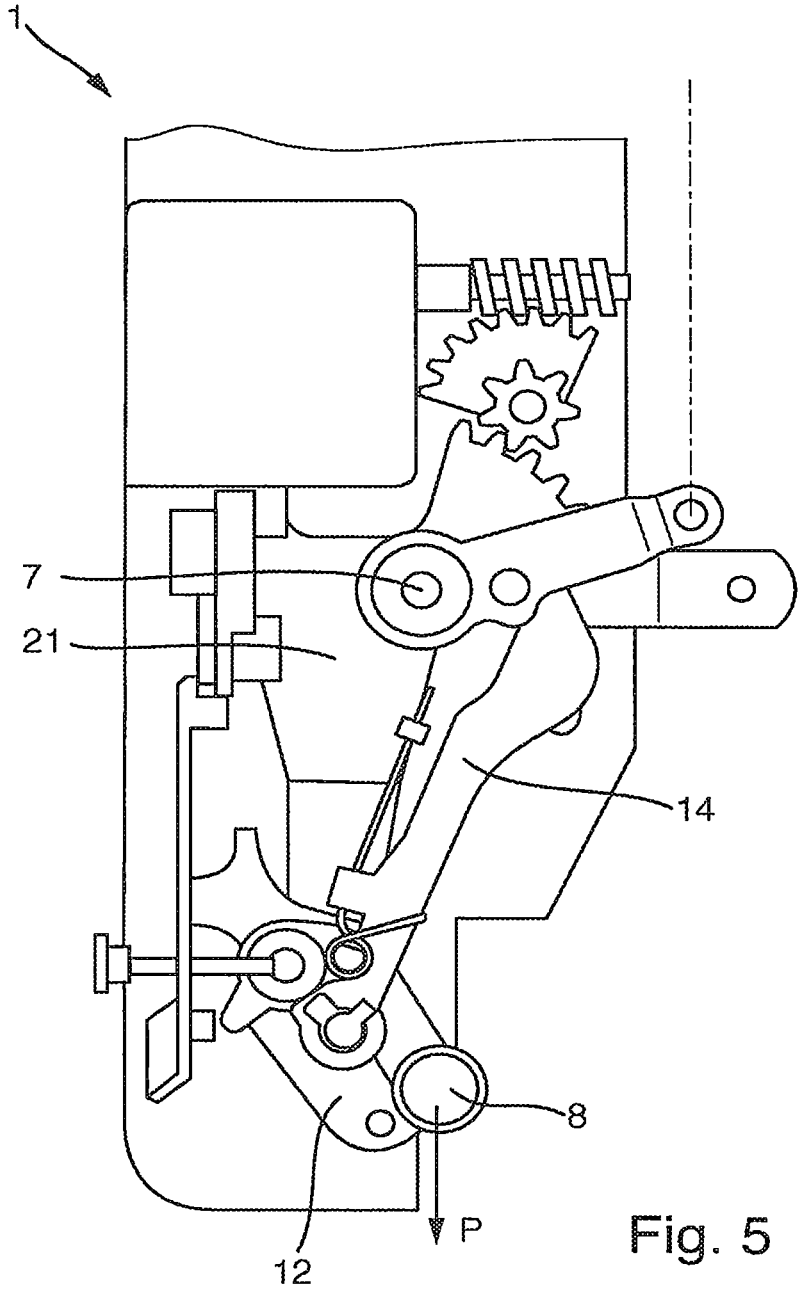
Figure 6:
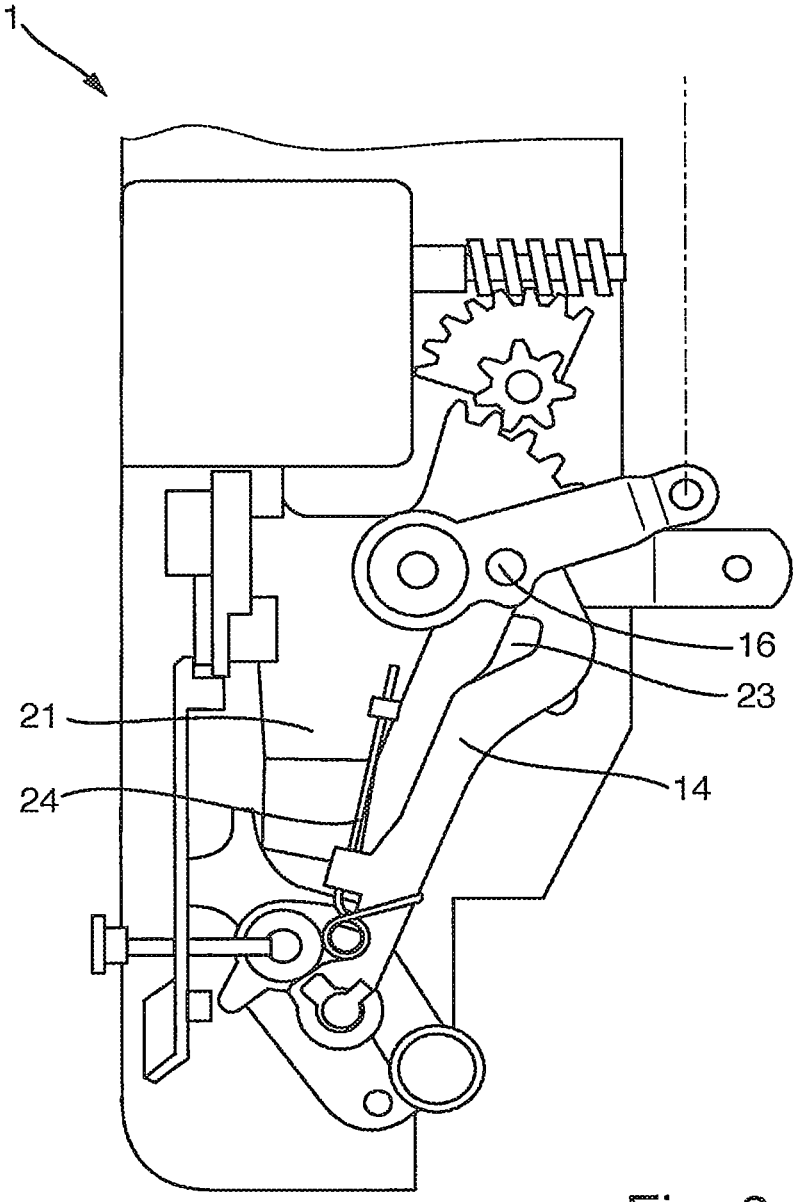
Figure 7:
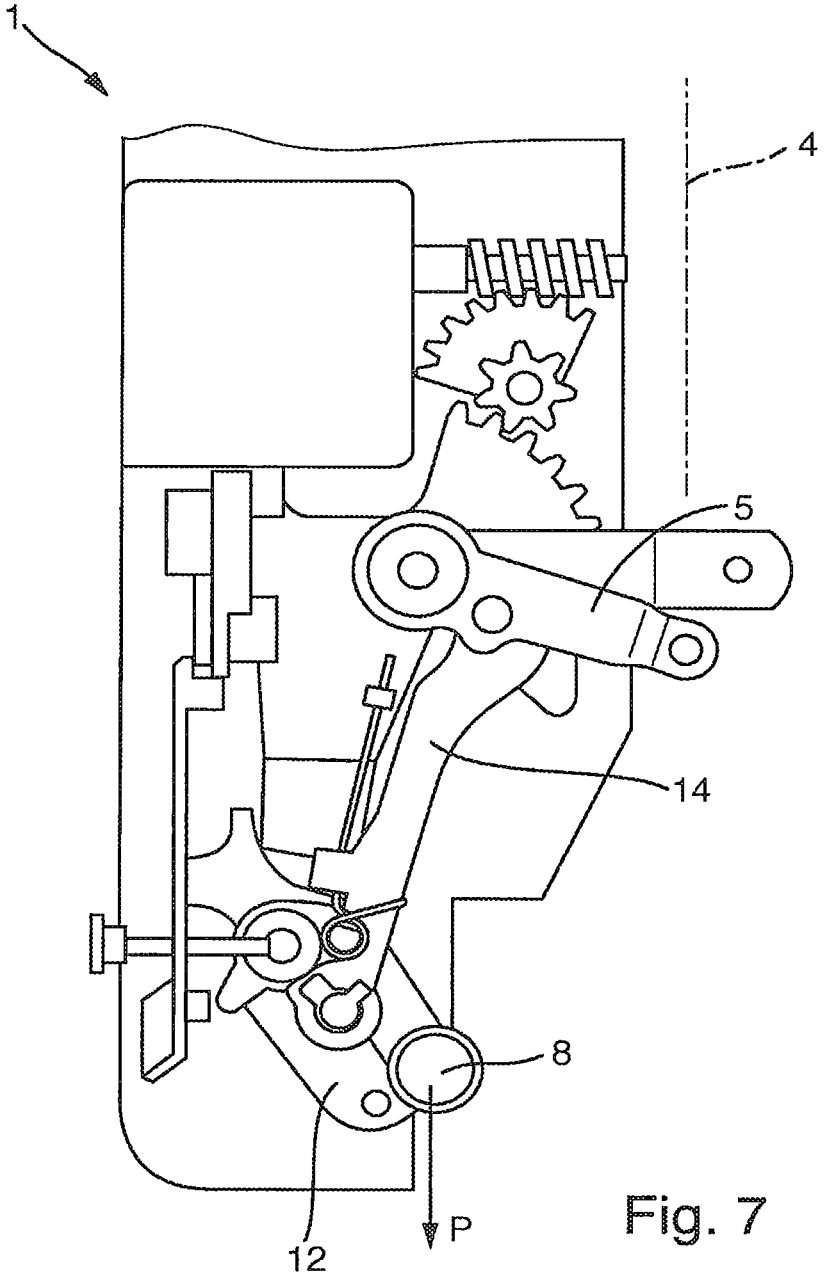
Figure 8:
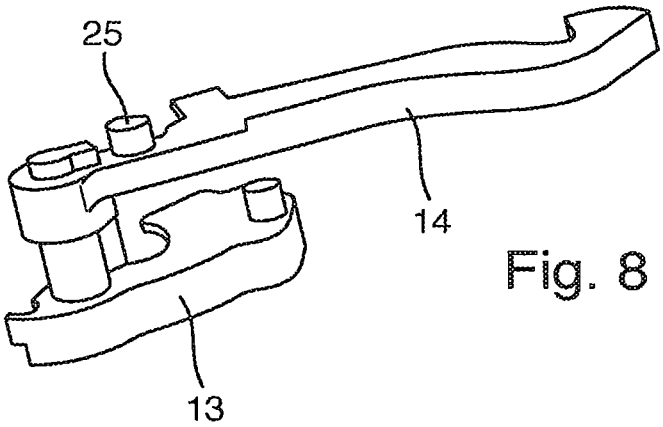
Figure 9:
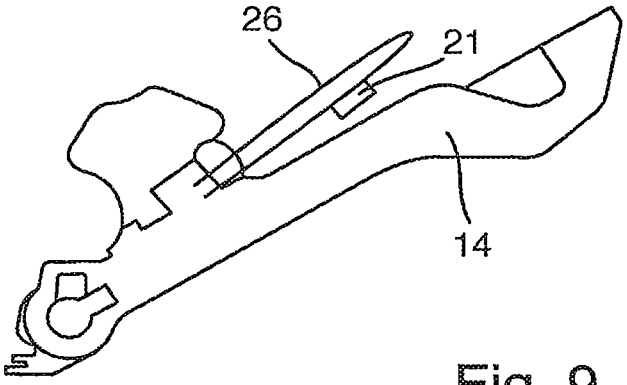

The following are shown:

FIG. 1 a three-dimensional view of an arrangement of a motor vehicle door latch and a theoretical position of an additional latch in an arrangement which serves as an example in a sliding door, with an indicated connection between the motor vehicle door latch and the additional latch, FIG. 2 a three-dimensional view onto a motor vehicle door latch according to FIG. 1, whereby the motor vehicle door latch is depicted without a housing lid and only with the constructional elements explaining the invention, FIG. 3 a lateral view of the opened motor vehicle latch according to FIG. 2 in a functional position unactivated and unbolted, FIG. 4 a lateral view of the motor vehicle latch according to FIG. 2 in the functional position unactivated and bolted, FIG. 5 a lateral view of a motor vehicle latch according to FIG. 2 in the functional position of the first activation lever activated and bolted, FIG. 6 a lateral view of a motor vehicle latch according to FIG. 2 in the functional position of the first activation lever activated and bolted, whereby a convenience function is illustrated in this figure, FIG. 7 a lateral view of a motor vehicle latch according to FIG. 2 in a functional position of the first and second activation lever activated and primary and secondary latch unbolted, FIG. 8 a three-dimensional view of the accommodation of the coupling lever with an accommodation of the coupling lever in the motor vehicle latch serving as an example, and FIG. 9 a top view of a coupling lever according to the invention with an arranged bearing point in the motor vehicle door latch.

FIG. 1 shows a three-dimensional view of a motor vehicle door latch 1 in a theoretical position to a further motor vehicle door latch 2 in a theoretically depicted sliding door 3. In this arrangement, the motor vehicle door latch 1 forms the primary latch; in contrast, the further motor vehicle door latch 2 forms the secondary latch 2. The secondary latch 2 can also be described as an additional latch 2. A mechanical connection is theoretically depicted between the primary latch 1 and the additional latch 2 which can be a Bowden cable 4 for example. The Bowden cable 4 connects the second activation lever 5 to the triggering and/or activation lever 6 on the additional latch 2. The second activation lever 5 is pivotably accommodated in the primary latch 1 by means of the axis 7. A first activation lever 8 is only apparent in places here as the first activation lever 8 is concealed by the housing lid 9. The first activation lever 8 can also be activated by means of a Bowden cable, for example, whereby the Bowden cable is not illustrated, but can be inserted and fixed into the mounting 10 of the housing lid 9 for example.

In FIG. 2, the motor vehicle door latch or the primary latch 1 according to FIG. 1 is illustrated in a three-dimensional view but without a housing lid 9. Furthermore, only the components of the motor vehicle door latch 1 were illustrated which are significant in explaining the function of the invention. The same components are furnished with the same reference figures. The first activation lever 8 is pivotably accommodated in the axis 11. A triggering lever 12 is arranged below the first activation lever 8 which is also accommodated on the axis 11. On activation of the first activation lever, the external activation lever 8 is moved against the triggering lever 12 so that an unrecognizable locking mechanism can be unlocked by means of a first coupling lever 13. The second coupling lever 14 is pivotably accommodated on the first coupling lever 13 and in particular on an extension 15 of the first coupling lever 13. The coupling lever 14 engages into the graded mandrel 16 on the second activation lever 5 in a form-fitting and detachable manner. The activation lever chain for activation of the secondary latch or additional latch 2 therefore takes place according to the illustrated embodiment example by means of the first activation lever 8, the triggering lever 12, the first coupling lever 13, the second coupling lever 14, the graded mandrel 16, the second activation lever 5 and the Bowden cable 4.

An internal locking lever 17, an internal activation lever 18 and an electrical drive 19, with a wormgear 20 are also apparent. The locking lever 21 can be electrically activated by means of the electrical drive and the wormgear. The locking lever can also be pivoted by means of the internal locking lever 17 and an external locking lever 22.

In the following FIGS. 3 to 7, the function of the primary latch 1 should be explained in interplay with the additional latch 2 and the functionalities resulting from the invention. In FIG. 3, the lateral view of the primary latch 1 is reproduced in a lateral view according to FIG. 2 without a housing lid 9. The state of the latch is illustrated in which the primary latch 1 is neither activated nor bolted. The first activation lever 8 is located in its starting position and the second coupling lever 14 engages into the graded mandrel 16 so that a mechanical connection is guaranteed between the first activation lever 8 and the second activation lever 5. All components such as also the locking lever 21 are located in a position in which the primary latch 1 and the additional latch 2 could be unlocked by means of an external door handle or an internal door handle, if these are activated.

In FIG. 4 the primary latch 1 is reproduced in turn in a lateral view according to FIG. 2 without a housing lid 9, whereby the also unactivated state is shown here; however, the primary latch 1 is present in the bolted state. Unactivated means that neither the internal activation lever nor the external activation lever or the first activation lever 8 are activated. The bolted state also means that the first coupling lever 13 is disengaged from the locking mechanism and that the second coupling lever 14 was pivoted around an angle in a clockwise direction so that the second coupling lever 14 is disengaged from the graded mandrel 16. Activation of the internal or external activation lever 8, 18 would consequently not lead to unlocking of the main latch 1 and the additional latch 2 as both the first coupling lever 13 and the second coupling lever 14 are disengaged.

In FIG. 5, in turn, a lateral view in turn on the primary latch 1 is reproduced according to FIG. 2 without a housing lid 9, whereby the activated and bolted state is illustrated. According to FIG. 4, the primary latch 1 was present in the bolted state so that the first and second coupling levers 13, 14 were disengaged. In FIG. 5 the external activation lever or first activation lever 8 was pivoted in the direction of the arrow P. The consequence of pivoting of the first activation lever 8 is that the triggering lever 12 and also the second coupling lever 14 are also moved in the direction of the arrow P. However, as the bolted state is present, the movement of the first activation lever 8 has no effect on the primary latch 1 and the additional latch 2, so that an operator who pulls the external door handle cannot open the door.

In order to bolt the primary latch 1 and the secondary latch 2 the external locking lever 22 was pivoted around the axis 7 so that both the second coupling lever 14 and also the first coupling lever 13 were disengaged.

In FIG. 6, the embodiment of a convenience function according to the invention is now reproduced for the additional latch 2. If the primary latch 1 is electrically unbolted, for example, in the state according to FIG. 5, in which the first activation lever was activated, the locking lever 21 thus moves in a clockwise direction into the position illustrated in FIG. 6. However, the second coupling lever 14 cannot engage into the graded mandrel 16 as the contour 23 which engages into the graded mandrel 16 is located below the graded mandrel 16. In this case, the spring 24 pre-tensions the second coupling lever 14 so that the "Unbolted" function is saved. Saving of the "Unlocking" function constitutes the convenience function. If the second coupling lever reverts to its starting position after release of the external door handle, for example, the spring force of the spring 24 causes the contour 23 to engage with the graded mandrel 16 without requiring a further action by an operator. The "Unbolted" function is assumed independently so that with repeated activation of the external door handle the locking mechanisms of the primary latch 1 and the secondary latch 2 are unlocked.

In FIG. 7, in turn, the lateral door latch or primary latch is reproduced according to FIG. 2 without a housing lid 9, namely in the activated and unbolted state. In the embodiment example, in turn, the external activation lever or the first activation lever 8 is pulled in the direction of the arrow P, whereby the triggering lever 12 is moved and the locking mechanism of the primary latch 1 is unlocked. Furthermore, the second activation lever 5 is pivoted by means of the coupling lever 14 so that by means of a movement of a Bowden cable 4, for example, the additional latch 2 can also be unlocked.

In FIG. 8, the second coupling lever 14 is reproduced in relation to accommodation on the first coupling lever 13. A dual component construction is illustrated consisting of a first and second coupling lever 13, 14; however, it is also conceivable to execute the first and second coupling levers 13, 14 as a single-component construction. If the spring 24 is accommodated on the elevation 25 for storage of the convenience function and engages into the locking lever 21 with the long spring leg, so that a relative force can be executed between the coupling lever 14 and the locking lever 21, it is also conceivable to mold a spring arm 26 to the second coupling lever 14 as a single component, whereby the spring arm 26 takes over the convenience function and interacts with the locking lever 21 for storage of the convenience function. Formation of the second coupling lever 14 with a spring arm 26 is reproduced as an example in FIG. 9.

LIST OF REFERENCE SYMBOLS

1 Motor vehicle door latch, main latch, lateral door latch
2 Further motor vehicle door latch, secondary latch, additional latch
3 Sliding door
4 Mechanical connection, Bowden cable
5 Second activation lever
6 Triggering and/or activation lever on the additional latch
7 Axis
8 First activation lever
9 Housing lid
10 Mounting
11 Axis, first activation lever
12 Triggering lever
13 First coupling lever
14 Second coupling lever
15 Extension
16 Graded mandrel
17 Internal locking lever
18 Internal activation lever
19 Electrical drive
20 Worm
21 Locking lever
22 External locking lever
23 Contour
24 Spring
25 Mounting
26 Spring arm
P Arrow

The invention claimed is:

1. A motor vehicle door latch assembly comprising:

a primary latch having a first housing containing a first locking mechanism with a catch and at least a pawl, a triggering lever configured to unlock the first locking mechanism, and a first activation lever configured to activate the triggering lever, and a secondary latch, wherein the triggering lever is connected to the secondary latch having a second housing arranged remotely relative to the primary latch and having a secondary locking mechanism, wherein the first activation lever of the primary latch is configured to unlock both the first locking mechanism and the secondary locking mechanism of the secondary latch, wherein the primary latch includes a second activation lever that is activated by the first activation lever and is connected to the first activation lever by a coupling lever that is pivotably mounted to the primary latch whereby the coupling lever directly follows a movement of the first activation lever.

2. The motor vehicle door latch assembly according to claim 1, wherein the coupling lever is connected to the second activation lever in a form-fitting manner and/or detachably.

3. The motor vehicle door latch assembly according to claim 1, wherein the coupling lever is connected to the second activation lever by a graded mandrel arranged on the second activation lever.

4. The motor vehicle door latch assembly according to claim 1, wherein the second activation lever is accommodated on an axis of a locking element.

5. The motor vehicle door latch assembly according to claim 4, wherein the axis simultaneously acts as a mounting for a locking mechanism component.

6. The motor vehicle door latch assembly according to claim 4, wherein the coupling lever is detached from engagement with the second activation lever by the locking element.

7. The motor vehicle door latch assembly according to claim 1, wherein a bearing point of the coupling lever and an engagement point of the coupling lever on the second activation lever are formed to provide angular movements of the second activation lever.

8. The motor vehicle door latch assembly according to claim 1, wherein the second activation lever is accommodated on an axis of a locking lever.

9. The motor vehicle door latch assembly according to claim 1, wherein the secondary latch has a secondary latch activation lever, wherein the second activation lever and the secondary latch activation lever are connected by a connecting element that is directly attached to each of the second activation lever and the secondary latch activation lever, wherein the first activation lever of the primary latch is configured to unlock both the first locking mechanism and the secondary locking mechanism of the secondary latch via the connecting element connecting the second activation lever and the secondary latch activation lever.

10. The motor vehicle door latch assembly according to claim 9, wherein the connecting element is a Bowden cable.

11. The motor vehicle door latch assembly according to claim 9 further comprising a second coupling lever pivotably accommodated on the first coupling lever, wherein the second coupling lever is engageable with the second activation lever.

12. The motor vehicle door latch assembly according to claim 11, wherein the second coupling lever is connected to the second activation lever via a graded mandrel arranged on the second activation lever.

* * * * *